US009200847B2

(12) United States Patent
Thompson

(10) Patent No.: US 9,200,847 B2
(45) Date of Patent: Dec. 1, 2015

(54) METHOD AND SYSTEM FOR VARIABLE SPEED BLOWER CONTROL

(75) Inventor: Kevin D. Thompson, Indianapolis, IN (US)

(73) Assignee: CARRIER CORPORATION, Farmington, CT (US)

( * ) Notice: Subject to any disclaimer, the term of this patent is extended or adjusted under 35 U.S.C. 154(b) by 947 days.

(21) Appl. No.: 13/366,482

(22) Filed: Feb. 6, 2012

(65) Prior Publication Data

US 2012/0199109 A1 Aug. 9, 2012

Related U.S. Application Data

(60) Provisional application No. 61/440,061, filed on Feb. 7, 2011.

(51) Int. Cl.
*F24F 11/00* (2006.01)
*F27D 19/00* (2006.01)

(52) U.S. Cl.
CPC ..... *F27D 19/00* (2013.01); *F24F 2011/0041* (2013.01)

(58) Field of Classification Search
CPC ..... F23N 2005/182; F23N 2025/04; F23N 2025/06; F23N 5/18; F24D 19/1084; F24F 11/0079; F24F 11/022; F24F 11/04; F24F 2011/0041; F24F 2011/0042; F24H 3/06
USPC ..... 126/99 R, 110 R, 112, 116 A, 116 R; 236/10, 15 C, 15 R
See application file for complete search history.

(56) References Cited

U.S. PATENT DOCUMENTS

| | | | | | |
|---|---|---|---|---|---|
| 2,454,511 | A | * | 11/1948 | Heymann et al. | 126/110 R |
| 3,005,887 | A | * | 10/1961 | Robson | 200/81.9 R |
| 3,612,164 | A | * | 10/1971 | Miner | 165/216 |
| 3,759,098 | A | * | 9/1973 | Logsdon et al. | 73/861.52 |
| 3,841,394 | A | * | 10/1974 | Van Becelaere | 165/217 |
| 3,852,547 | A | * | 12/1974 | Dietz | 200/83 Y |
| 4,257,318 | A | * | 3/1981 | Johannsen | 454/229 |
| 4,344,330 | A | * | 8/1982 | Renken et al. | 73/861.66 |
| 4,638,233 | A | * | 1/1987 | Erdman | 318/644 |
| 4,648,551 | A | * | 3/1987 | Thompson et al. | 236/49.3 |
| 4,860,231 | A | * | 8/1989 | Ballard et al. | 702/47 |
| 4,978,896 | A | * | 12/1990 | Shah | 318/400.08 |
| 5,019,757 | A | * | 5/1991 | Beifus | 318/400.07 |
| 5,202,951 | A | * | 4/1993 | Doyle | 388/811 |
| 5,331,944 | A | * | 7/1994 | Kujawa et al. | 126/110 R |
| 5,492,273 | A | * | 2/1996 | Shah | 236/44 A |
| 5,522,541 | A | | 6/1996 | Zia et al. | |
| 5,524,556 | A | | 6/1996 | Rowlette et al. | |
| 5,559,407 | A | | 9/1996 | Dudley et al. | |
| 5,592,058 | A | * | 1/1997 | Archer et al. | 318/400.09 |
| 5,592,059 | A | | 1/1997 | Archer | |
| 5,791,332 | A | | 8/1998 | Thompson et al. | |
| 5,806,440 | A | | 9/1998 | Rowlette et al. | |
| 6,186,744 | B1 | * | 2/2001 | Wolochuk | 417/44.2 |

(Continued)

*Primary Examiner* — Jorge Pereiro
(74) *Attorney, Agent, or Firm* — Cantor Colburn LLP

(57) ABSTRACT

A method of controlling a blower motor in a furnace includes applying control signals to the blower motor; determining that a reference airflow through a portion of the furnace is present; determining a reference control signal at which the reference air flow is present; receiving a requested airflow; computing a requested control signal in response to the reference air flow, the reference control signal and the requested airflow; and using the requested control signal to control the blower motor.

14 Claims, 2 Drawing Sheets

(56) References Cited

U.S. PATENT DOCUMENTS

| | | | | |
|---|---|---|---|---|
| 6,227,961 | B1 * | 5/2001 | Moore et al. | 454/229 |
| 6,601,460 | B1 * | 8/2003 | Materna | 73/861.52 |
| 6,866,202 | B2 * | 3/2005 | Sigafus et al. | 236/11 |
| 6,923,072 | B2 * | 8/2005 | Modera et al. | 73/861 |
| 7,101,172 | B2 * | 9/2006 | Jaeschke | 431/19 |
| 7,174,791 | B2 * | 2/2007 | Modera et al. | 73/861 |
| 7,293,718 | B2 * | 11/2007 | Sigafus et al. | 236/11 |
| 7,431,568 | B2 | 10/2008 | Brown et al. | |
| 7,567,049 | B2 * | 7/2009 | Shahi et al. | 318/432 |
| 7,735,743 | B2 | 6/2010 | Jaeschke | |
| 8,146,584 | B2 * | 4/2012 | Thompson | 126/116 A |
| 8,261,733 | B2 * | 9/2012 | Hugghins | 126/116 A |
| 8,408,878 | B2 * | 4/2013 | Shahi et al. | 417/1 |
| 8,672,670 | B2 * | 3/2014 | Hugghins | 431/2 |
| 2003/0042860 | A1 * | 3/2003 | Sulfstede | 318/432 |
| 2003/0059730 | A1 * | 3/2003 | Sigafus et al. | 431/18 |
| 2003/0154803 | A1 * | 8/2003 | Modera et al. | 73/861.52 |
| 2004/0043345 | A1 * | 3/2004 | Jaeschke | 431/18 |
| 2005/0159844 | A1 * | 7/2005 | Sigafus et al. | 700/275 |
| 2005/0241293 | A1 * | 11/2005 | Modera et al. | 60/226.1 |
| 2005/0255417 | A1 * | 11/2005 | Brown et al. | 431/18 |
| 2005/0280384 | A1 * | 12/2005 | Sulfstede | 318/432 |
| 2007/0003891 | A1 * | 1/2007 | Jaeschke | 431/19 |
| 2007/0271934 | A1 * | 11/2007 | Lyon | 62/94 |
| 2008/0000246 | A1 | 1/2008 | Ha et al. | |
| 2008/0127962 | A1 | 6/2008 | Thompson | |
| 2010/0068070 | A1 * | 3/2010 | Shahi et al. | 417/1 |
| 2011/0100349 | A1 * | 5/2011 | Hugghins | 126/116 A |
| 2011/0111352 | A1 * | 5/2011 | Hugghins | 431/2 |
| 2011/0162591 | A1 * | 7/2011 | Fan et al. | 122/14.21 |
| 2011/0217182 | A1 * | 9/2011 | Hanewald | 417/1 |
| 2012/0310419 | A1 * | 12/2012 | Hugghins | 700/276 |

* cited by examiner

METHOD AND SYSTEM FOR VARIABLE SPEED BLOWER CONTROL

CROSS-REFERENCE TO RELATED APPLICATIONS

This application claims priority to U.S. provisional application 61/440,061, filed Feb. 7, 2011, the entire contents of which are incorporated herein by reference.

BACKGROUND OF THE INVENTION

The subject matter disclosed herein generally relates to air blowers, and in particular to a method and system for providing variable speed blower control.

Heating, ventilation and air conditioning (HVAC) systems typically use a blower driven by a blower motor to supply air through ducts. HVAC systems are typically designed to provide an amount of airflow expressed as cubic feet per minute (CFM) (cubic meters per second in SI units) in certain modes. For example, low heat, high heat, cooling and continuous fan may all utilize different airflows. There is a need to simply and efficiently control the blower motor through different modes of operation.

BRIEF DESCRIPTION OF THE INVENTION

An embodiment is a method of controlling a blower motor in a furnace, the method comprising: applying control signals to the blower motor; determining that a reference airflow through a portion of the furnace is present; determining a reference control signal at which the reference air flow is present; receiving a requested airflow; computing a requested control signal in response to the reference air flow, the reference control signal and the requested airflow; and using the requested control signal to control the blower motor.

Another embodiment is a system for handling air including a blower; a blower motor; and a controller for controlling the blower motor, the controller applying control signals to the blower motor; determining that a reference airflow through a portion of the furnace is present; determining a reference control signal at which the reference air flow is present; receiving a requested airflow; computing a requested control signal in response to the reference air flow, the reference control signal and the requested airflow; and using the requested control signal to control the blower motor.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 1:
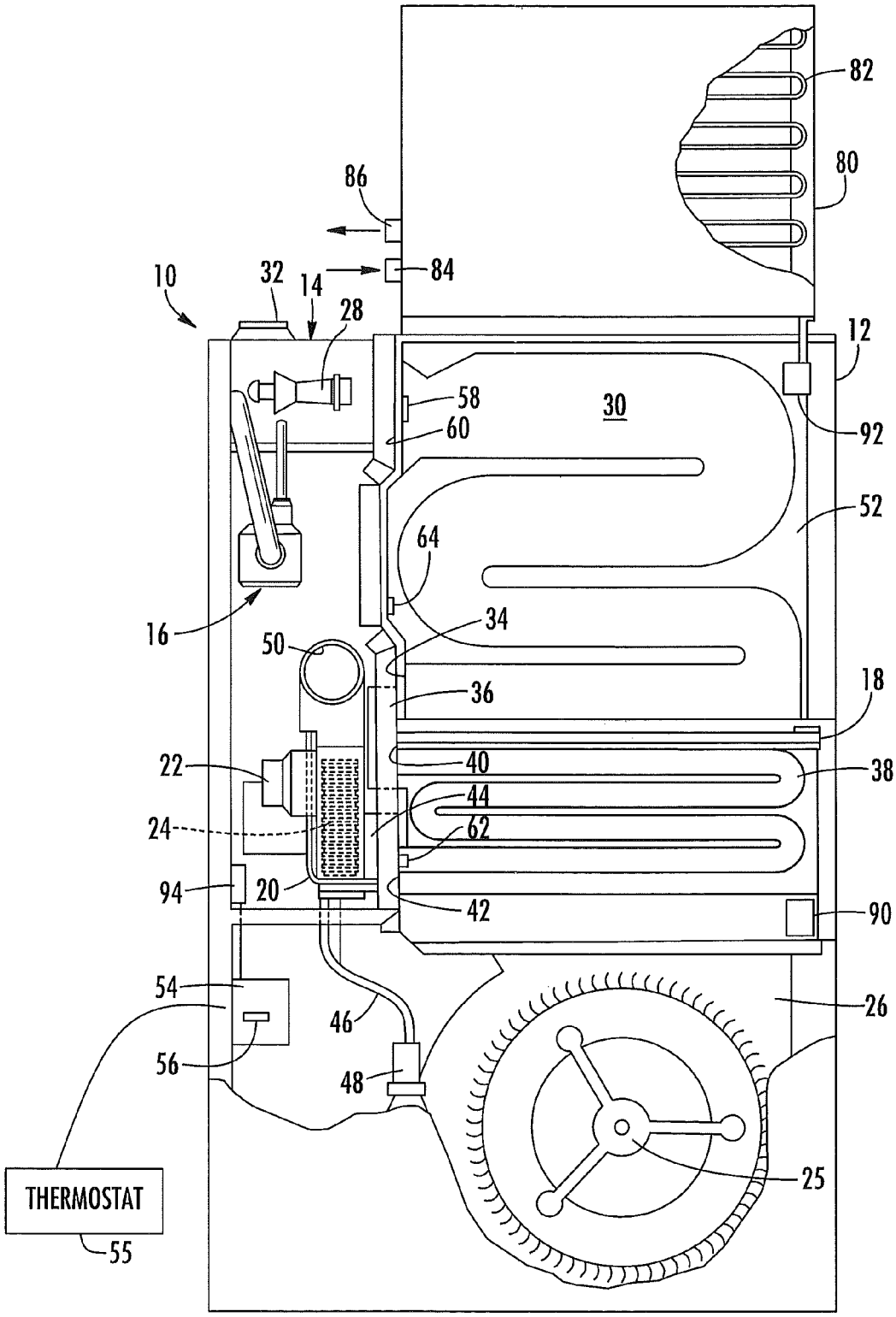
FIG. 1 depicts an exemplary furnace having an evaporator coil.

Referring to FIG. 1, the numeral 10 generally designates a gas-fired condensing furnace employing the blower motor control of the present invention. Condensing furnace 10 includes a steel cabinet 12 housing therein burner assembly 14, combination gas control 16, heat exchanger assembly 18, inducer housing 20 supporting, inducer motor 22 and inducer wheel 24, and circulating air blower 26. Combination gas control 16 includes a hot surface igniter (not shown) to ignite the fuel gas.

Burner assembly 14 includes at least one inshot burner 28 for at least one primary heat exchanger 30. Burner 28 receives a flow of combustible gas from gas regulator 16 and injects the fuel gas into primary heat exchanger 30. A part of the injection process includes drawing air into heat exchanger assembly 18 so that the fuel gas and air mixture may be combusted therein. A flow of combustion air is delivered through combustion air inlet 32 to be mixed with the gas delivered to burner assembly 14.

Primary heat exchanger 30 includes an outlet 34 opening into chamber 36. Connected to chamber 36 and in fluid communication therewith are at least four condensing heat exchangers 38 having an inlet 40 and an outlet 42. Outlet 42 opens into chamber 44 for venting exhaust flue gases and condensate.

Inducer housing 20 is connected to chamber 44 and has mounted thereon an inducer motor 22 together with inducer wheel 24 for drawing the combusted fuel air mixture from burner assembly 14 through heat exchanger assembly 18. Air blower 26 is driven by blower motor 25 and delivers air to be heated in a counterflow arrangement upwardly through air passage 52 and over heat exchanger assembly 18. The cool air passing over condensing heat exchanger 38 lowers the heat exchanger wall temperature below the dew point of the combusted fuel air mixture causing a portion of the water vapor in the combusted fuel air mixture to condense, thereby recovering a portion of the sensible and latent heat energy. The condensate formed within heat exchanger 38 flows through chamber 44 into drain tube 46 to condensate trap assembly 48. As air blower 26 continues to urge a flow of air, upwardly through heat exchanger assembly 18, heat energy is transferred from the combusted fuel air mixture flowing through heat exchangers 30 and 38 to heat the air circulated by blower 26. Finally, the combusted fuel air mixture that flows through heat exchangers 30 and 38 exits through outlet 42 and is then delivered by inducer motor 22 through exhaust gas outlet 50 and thence to a vent pipe (not illustrated).

Cabinet 12 also houses a controller 54 and a display 56. Controller 54 may be implemented using a microprocessor-based controller executing computer program code stored on a computer readable storage medium. A thermostat 55 communicates with controller 54 to designate operational modes and temperature. Thermostat 55 may be an intelligent device that communicates requested air flow rates as described in further detail herein. A pressure tap 58 is located at primary heat exchanger inlet 60, a pressure tap 62 is located at condensing heat exchanger outlet 42 and a limit switch 64 is disposed in air passage 52. In a non-condensing furnace, pressure tap 62 would be disposed at primary heat exchanger outlet 34, since there would be no condensing heat exchanger 38.

A first airflow pressure tap 90 is positioned near the outlet of blower 26. A second airflow pressure tap 92 is positioned downstream of the first pressure tap 90, near the outlet of primary heat exchanger 30. First pressure tap 90 and second pressure tap 92 are fluidly coupled (e.g., via tubing) to a pressure switch 94 in the cabinet 12. Pressure switch 94 is designed to change state (e.g., close) upon a predetermined pressure differential between pressure taps 90 and 92. The predetermined pressure differential between pressure taps 90 and 92 is indicative of a predetermined reference airflow, $CFM_{REF}$, through the furnace and provided to ducting coupled to the furnace. Pressure switch 94 provides a signal (e.g., a 24 VAC signal) to controller 54 indicating that the predetermined pressure differential has been reached.

A cooling coil 82 is located in housing 80 on top of furnace cabinet 10 and is the evaporator of air conditioning system. The cooling coil 82 has an inlet 84, where subcooled refrigerant enters, and an outlet 86, where superheated refrigerant leaves, as is conventional. In response to an input from heating/cooling thermostat 55, air blower 26 urges air flow upwardly through cooling coil 82 where heat exchange takes place. As a result of this heat exchange, cool air is delivered to the conditioned space and superheated refrigerant is returned to the outdoor condensing section (not illustrated) via outlet 86. In the outdoor condensing section the refrigerant is subcooled and returned to inlet 84. This cycle continues until the thermostat is satisfied.

In operation, the controller 54 controls blower motor 25 by providing a control signal to the motor 25. The control signal may be a pulse width modulated (PWM) signal indicating a duty cycle for blower motor 25. In exemplary embodiments, the control signal is a 12-bit PWM control signal. It is understood that analog control signals may be used, or different types of digital codes may be used to provide the control signal. Controller 54 determines the appropriate control signal in response to a transfer function stored in controller 54, and described in further detail herein.

Figure 2:
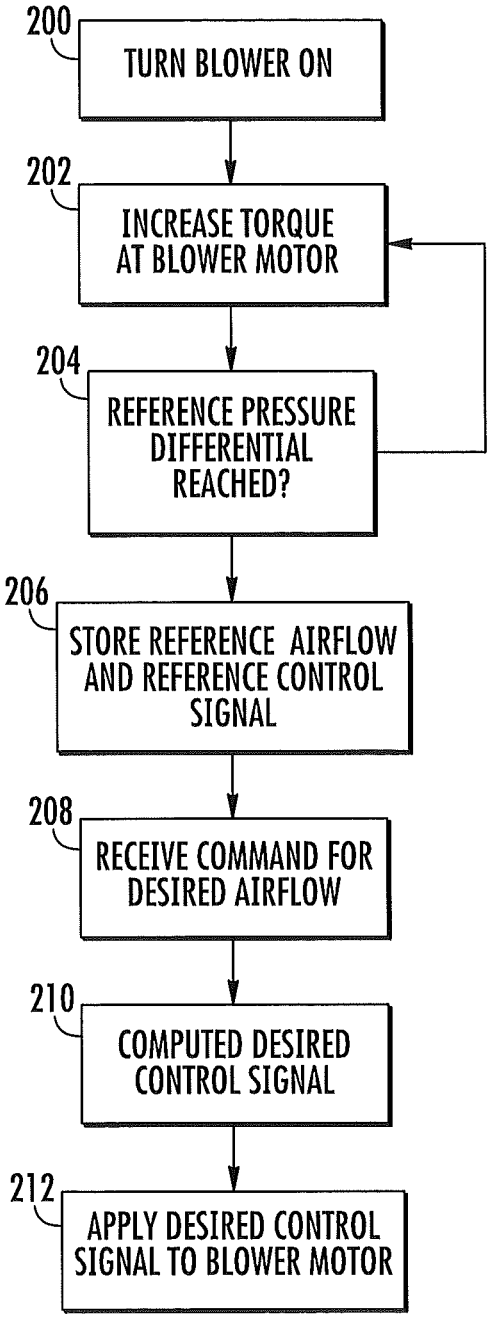
FIG. 2 is a flowchart of an exemplary control process.

FIG. 2 is a flowchart of a process for providing variable speed control for blower motor 25. The process begins at 200 where the blower motor 25 is turned on. This may be in response to a request from thermostat 55. At 202, the controller 54 gradually ramps up the blower motor torque by adjusting the control signal (e.g., increasing PWM) to the motor 25. At 204, controller 54 determines if the pressure switch 94 has changed states to indicate that the predetermined differential pressure between pressure taps 90 and 92 has been reached. If not, the process returns to 202 to step increase torque at blower motor 25.

When the pressure switch 94 changes states, flow proceeds to 206. Controller 54, in response to a signal from pressure switch 94, stores the current control signal value as a reference control signal. In this manner, controller 54 knows that a predetermined reference airflow, $CFM_{REF}$, is obtained when the reference control signal is applied to the blower motor 25. The reference control signal is stored in the controller at 206, along with the reference airflow, which may be stored in the controller 54 prior to executing the method of FIG. 2.

At 208, the controller receives a request for a requested airflow. The requested airflow may be communicated from thermostat 55 or determined by the controller 54 based on the selected mode of operation. For example, a standard mode may use 350 CFM/ton (0.165 $m^3$/s/ton), a dehumidifying mode 275 CFM/ton (0.130 $m^3$/s/ton), a super dehumidifying mode 200 CFM/ton (0.094 $m^3$/s/ton) and a maximum mode 400 CFM/ton (0.189 $m^3$/s/ton). At 210, controller 54 uses a transfer function to compute the appropriate control signal to apply to blower motor 26. Controller 54 calculates a requested control signal (e.g., PWM) needed to supply the requested airflow based on fan laws, as PWM is proportional to motor torque, and motor torque is proportional to the square of the CFM. As controller 54 knows the reference airflow, the reference control signal and the requested airflow, the transfer function is employed to solve for the requested control signal. Accordingly, the requested control signal is computed as a function of reference airflow, the reference control signal and the requested airflow. At 212, the requested control signal is applied to the blower motor 25, to achieve the requested airflow.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A system for handling air comprising:
- a blower;
- a blower motor; and
- a controller for controlling the blower motor, the controller:
  - applying control signals to the blower motor;
  - determining that airflow through a portion of the furnace meets a reference airflow;
  - determining a reference control signal at which the reference airflow is present;
  - receiving a requested airflow;
  - computing a requested control signal in response to the reference airflow, the reference control signal and the requested airflow; and
  - using the requested control signal to control the blower motor;
- wherein determining that airflow through the portion of the furnace meets the reference airflow includes monitoring a pressure switch to determine whether the reference airflow is present, the pressure switch changing states when the reference airflow is present through the portion of the furnace.

2. The system of claim 1 wherein:
- the pressure switch is fluidly coupled to a first pressure tap and a second pressure tap, the pressure switch changing states when a predetermined pressure differential exists between the first pressure tap and a second pressure tap.

3. The system of claim 2 wherein:
- the first pressure tap is located near an outlet of the blower.

4. The system of claim 3 wherein:
- the second pressure tap is located downstream of the first pressure tap.

5. The system of claim 4 wherein:
- the second pressure tap is located near an output of a heat exchanger.

6. The system of claim 1 wherein:
- the reference control signal is a pulse width modulation value.

7. The system of claim 1 wherein:
- the requested airflow is expressed in cubic feet per minute.

8. A method of controlling a blower motor in a furnace, the method comprising:
- applying control signals to the blower motor;
- determining that airflow through a portion of the furnace meets a reference airflow;
- determining a reference control signal at which the reference airflow is present;
- receiving a requested airflow;
- computing a requested control signal in response to the reference airflow, the reference control signal and the requested airflow; and
- using the requested control signal to control the blower motor;

wherein determining that airflow through the portion of the furnace meets the reference airflow includes monitoring a pressure switch to determine whether the reference airflow is present, the pressure switch changing states when the reference airflow is present through the portion of the furnace.

9. The method of claim 8 wherein:

the pressure switch is fluidly coupled to a first pressure tap and a second pressure tap, the pressure switch changing states when a predetermined pressure differential exists between the first pressure tap and a second pressure tap.

10. The method of claim 9 wherein:

the first pressure tap is located near an outlet of the blower.

11. The method of claim 10 wherein:

the second pressure tap is located downstream of the first pressure tap.

12. The method of claim 10 wherein:

the second pressure tap is located near an output of a heat exchanger.

13. The method of claim 8 wherein:

the reference control signal is a pulse width modulation value.

14. The method of claim 8 wherein:

the requested airflow is expressed in cubic feet per minute.

* * * * *